United States Patent [19]

Grise

[11] 4,164,646

[45] Aug. 14, 1979

[54] SOLID CURRENT CARRYING AND HEATABLE MEMBER WITH ELECTRIC CONNECTION

[76] Inventor: Frederick G. J. Grise, 87 Main St., Osterville, Mass. 02655

[21] Appl. No.: 899,482

[22] Filed: Apr. 24, 1978

[51] Int. Cl.[2] ..... H05B 3/08

[52] U.S. Cl. ..... 219/541; 13/25; 174/94 R; 219/213; 219/553; 338/331; 252/503; 290/2; 339/177 R

[58] Field of Search ..... 219/213, 520, 541, 552, 219/553; 252/503; 339/176 R, 176 M, 177 R, 196, 195; 338/331, 316; 174/94 R; 204/195 S; 13/18, 20, 22, 25, 31; 403/29, 30; 290/2

[56] References Cited

U.S. PATENT DOCUMENTS

| | | | |
|---|---|---|---|
| 1,440,202 | 12/1922 | Yoast | 219/520 |
| 2,003,625 | 6/1935 | Boyer | 338/331 |
| 2,903,547 | 9/1959 | Alexander | 219/541 |
| 3,032,635 | 5/1962 | Kraft | 219/553 X |
| 3,166,518 | 1/1965 | Barnard | 252/503 |
| 3,179,736 | 4/1965 | Ramsey | 13/25 |
| 3,345,448 | 10/1967 | Malkin | 13/25 |
| 3,400,253 | 9/1968 | Marker | 219/541 |
| 3,956,614 | 5/1976 | Hervert | 219/541 |
| 4,076,608 | 2/1978 | Fujishoro et al. | 174/94 R X |
| 4,085,333 | 4/1978 | Grise et al. | 290/2 |

*Primary Examiner*—Volodymyr Y. Mayewsky
*Attorney, Agent, or Firm*—Charles R. Fay

[57] ABSTRACT

A current carrying member embedded in a brick-like member and having a wrapping comprising a flexible graphitic covering providing intimate contact with respect to the brick, also allowing the current carrying member and the brick to expand at different rates under conditions of heat while still retaining a very intimate electric contact.

10 Claims, 1 Drawing Figure

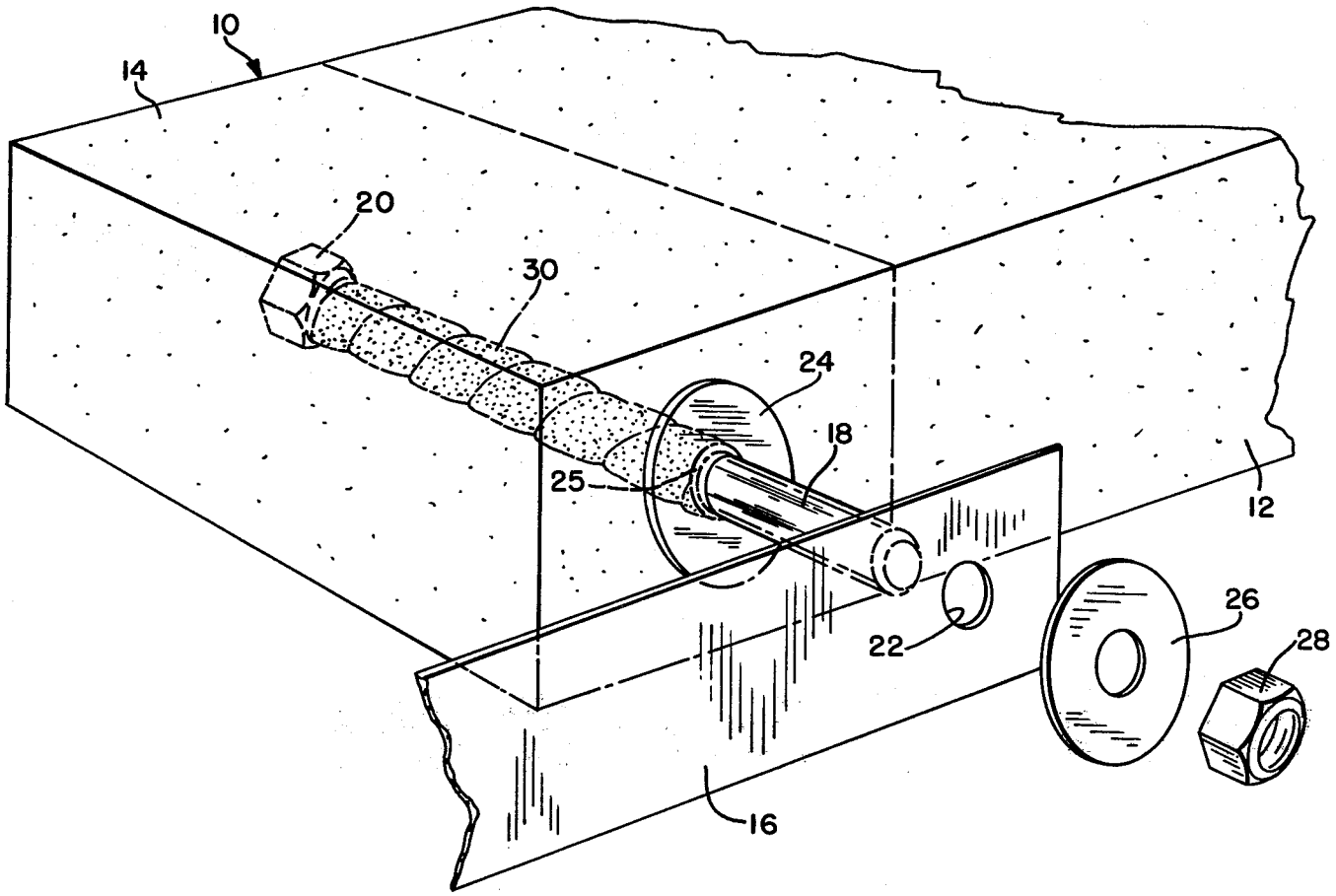
10
14
20
30
25
24
18
12
22
26
28
16

SOLID CURRENT CARRYING AND HEATABLE MEMBER WITH ELECTRIC CONNECTION

BACKGROUND OF THE INVENTION

Reference is hereby made to co-pending applications:

| Serial Number | Filing Date |
|---|---|
| 658,698 | February 17, 1976 |
| 854,615 | November 25, 1977 |
| 864,707 | December 27, 1977 |
| 864,706 | December 27, 1977 |
| 864,708 | December 27, 1977 |

The general purpose is to provide a heat retaining magma which is electrically heated e.g. during off peak hours, the heat being retrieved later for the purpose of providing steam for making additional electricity. These magmas may be used for other purposes requiring or benefiting from heat storage also.

In general the electricity traverses the brick heating the same due to the resistance of the bricks to passage of the electricity therethrough, and it is necessary to provide an electric contact placing the brick (or bricks) in circuit.

This has been found to present some difficulities due to the fact that the bricks are pitch bonded and are molded of discrete material comprising originally e.g. aluminum or magnesium oxide, intersperced with particles of carbon, it being preferred that the carbon particles be greater in number in the areas where the electricity is applied to the bricks.

An efficient way to provide for electricity to pass into a brick is to provide a hole to receive a bolt of electricity conducting material and to apply the electric contact or electrode thereto. The bolt may, as a matter of fact, be molded directly into the brick when the brick is made.

However, the material of the brick and the material of the bolt have different co-efficients of expansion under conditions of heat and thus at times the bolt will be relatively lose compared to the hole in which it is located in the brick. In any event, the brick being originally made of discrete particles, has a relatively rough surface including pits and, of course, this increases the resistance of the electricity in its passage from the bolt into the brick, tending to heat the brick to an undesired degree at the area of the junction of the bolt and the brick.

It is the object of the present invention to provide a construction which insures an extremely good contact between the brick and the bolt or other electrode to allow for different rates of expansion of the parts while still maintaining intimate contact, and also to cure the increased resistance due to pits and in some cases cracks and crumbling of portions of the bricks under conditions of use.

Although the graphitic sheets which are a part of the inventive concept in the present invention are old and well-known and are commercially available, being manufactured by Union Carbide Company, applicant is not aware of any prior art according to the present invention, the closest being his own co-pending application.

This application shows the use of semi-flexible graphitic sheets interposed between electrodes and the surface of the brick, etc., or between faces of two adjacent bricks, which improves the electric contact between the parts and insures good conductivity, obviating unwanted build up of heat at the electric contact area of the contiguous brick.

SUMMARY OF THE INVENTION

In the present case a brick which is to be heated has applied thereto, e.g. molded therein, a bolt-like member preferably metallic and electricity conductive. It may be provided with means to anchor it in place so it cannot be removed, and at the exterior of the brick it is provided with relatively simple means for applying an electrode or lead thereto.

Before the bolt is inserted or before it is inserted in the mold for the discrete material prior to molding etc., it has applied around it a sheet, tube, or strip of semi-flexible graphitic material e.g. as made by Union Carbide Company, under the trademark "Grafoil". This material conforms to all the nicks and crannies in the brick and maintains an excellent electrical connection between the bolt and the brick after it is molded and cured and under conditions of heat, accommodating different degrees of expansion. The graphitic material itself expands and contracts and is yieldable accommodating the parts.

BRIEF DESCRIPTION OF THE DRAWING

The drawing in the present case is a perspective view illustrating the invention.

PREFERRED EMBODIMENT OF THE INVENTION

The reference character 10 indicates a pitch bonded molded brick. This brick has been described in previous applications but in general it is molded of discrete aluminum or magnesium oxide having dispersed therein particles of carbon. In the area of the brick at 12, i.e. in the ends, the amount of scattered carbon is sufficient so that after the brick is cured and for instance heated to 1400° F., the electricity is carried through the brick which is a part of the electric circuit but the resistance is such as to cause the brick to heat up as desired. In the end portions of the bricks only one of which is shown as at 14, the carbon population is greater because this helps to maintain the brick at uniform heat from end to end. Without the greater population of the carbon particles in the end portions 14 the latter tend to heat to too great a degree and to greatly reduce the efficiency of the system.

These bricks are molded under pressure and are cured, whereupon the carbon particles therein are reduced to graphite particles, these graphite particles acting to aide in the conduction of electricity.

In order to apply the electricity to the end portions 14 of the brick, an electrode of any kind is applied thereto. However, as shown, a bolt 18 of electricity conducting material and preferably having an anchor head 20, is placed in the discrete material before molding so that an extending portion thereof can be later used for application of the plate 16 or other electrode thereto by means of the opening 22 through which the exposed portion of the bolt protrudes. These parts can be clamped in position as for instance against the head 24 integral with the bolt 18, and having a shoulder 25 ensuring that it does not contact the surface of the brick. A washer 26 and nut 28 may be used, and it will be clear therefore that the plate 16 is firmly connected with respect to the bolt but does not contact the brick, and the electric current passes into the bolt 18 and thence into the brick interiorly thereof.

However, before the bolt is placed in the mold for the brick, a layer or layers of "Grafoil" are wrapped about the bolt, this being indicated by the reference numeral 30. It is, of course, possible to take a square or rectangular sheet of "Grafoil" and wrap it around the bolt, and a graphitic tube may be used instead also. As shown the sheet material is applied in lengths which are wrapped around the shank of the bolt in spiral fashion with the various courses preferable overlapping, providing a cushion effect, and causing the graphitic material to adhere to the bolt and also to the interior of the brick adjacent to the bolt.

By this means an almost perfect electric contact is provided conducting the electricity from the bolt to the brick at almost all points there along and conforming to the somewhat irregular interior surface of the brick accommodating pits, cracks, small crumbling areas, and so forth. This "Grafoil" also allows the bolt to expand and contract relative to the bricks while still maintaining an almost perfect electrical contact therein. The graphitic material also expands and contracts and is yieldable and deformable.

I claim:

1. In a solid current carrying and heatable member, said member comprising a bonded brick of discrete material including graphitic current carrying paths therethrough, said paths having a relationship to the brick so that the latter heats upon the passage of electric current through it, electrical terminal means to apply electricity to the brick and the graphitic paths therein, said means comprising an elongated, substantially cylindrical, current carrying element embedded in the brick, the element and the brick being of different coefficients of expansion under conditions of heat, and the composition of the brick presenting a relatively rough surface to the element whereby the electric contact between element and brick may be relatively poor, said current carrying element extending outwardly from said heatable brick, an electrode being connected to the current carrying element exteriorly of the heatable brick, and an inaprevement that comprises a wrapping sheet tightly wrapping the current carrying element, said wrapping sheet being flexible and composed of graphite and forming a positive electric connection between heatable brick and the current carrying element.

2. The member of claim 1 wherein said flexible material is distortable so that it conforms to both the electricity carrying element and the current carrying solid member under conditions of changes of temperature.

3. The member of claim 1 wherein said current carrying member includes aluminum oxide.

4. The member of claim 1 wherein said current carrying member includes magnesium oxide.

5. The member of claim 1 wherein said current carrying flexible member is in the form of a sheet wrapped around said electricity conducting element.

6. The member of claim 1 wherein said flexible current carrying material is in the form of a strip wound in a generally helical manner about said current carrying element.

7. The member of claim 1 wherein the flexible current carrying material is in the form of a tube.

8. The member of claim 1 including means spacing the electrode from the brick.

9. The member of claim 1 wherein said graphitic material is yieldable.

10. The member of claim 1 wherein the graphitic material expands and contracts with changes in temperature.

* * * * *